US007715168B2

(12) United States Patent
Gofman et al.

(10) Patent No.: US 7,715,168 B2
(45) Date of Patent: May 11, 2010

(54) CONTROLLED SOLENOID DRIVE CIRCUIT

(75) Inventors: Igor Y. Gofman, Croton-on-Hudson, NY (US); Joseph T Webber, Jr., Glen Ridge, NJ (US)

(73) Assignee: ASCO Power Technologies LP, Florham Park, NJ (US)

( * ) Notice: Subject to any disclaimer, the term of this patent is extended or adjusted under 35 U.S.C. 154(b) by 300 days.

(21) Appl. No.: 11/429,777

(22) Filed: May 8, 2006

(65) Prior Publication Data

US 2007/0257628 A1 Nov. 8, 2007

(51) Int. Cl.
*H01H 9/00* (2006.01)

(52) U.S. Cl. ..... 361/160; 361/195

(58) Field of Classification Search ..... 361/160, 361/166, 191, 195
See application file for complete search history.

(56) References Cited

U.S. PATENT DOCUMENTS 3,244,965 A * 4/1966 Gutzwiller ..... 323/324
3,947,754 A * 3/1976 Wechsler ..... 323/300
4,125,885 A * 11/1978 Lowther et al. ..... 361/114
4,176,388 A * 11/1979 Palmer ..... 361/196
5,406,129 A * 4/1995 Gilmartin et al. ..... 307/125
5,953,198 A 9/1999 Murata et al.
6,087,777 A * 7/2000 Long ..... 315/82
7,045,916 B2 * 5/2006 Stolt et al. ..... 307/116
2005/0134121 A1 * 6/2005 Lathrop et al. ..... 307/80

FOREIGN PATENT DOCUMENTS

CN 1173722 A 2/1998

* cited by examiner

*Primary Examiner*—Danny Nguyen
(74) *Attorney, Agent, or Firm*—McDonnell Boehnen Hulbert & Berghoff LLP

(57) ABSTRACT

A method and system for proving a solenoid drive circuit. An exemplary solenoid drive circuit comprises a solenoid drive circuit input coupled to a primary switch. The primary switch comprises a first set of contacts residing in a first stable position. A remote control switch is coupled to an output of the primary switch and the remote control switch comprises a solenoid drive circuit having a predetermined delay. The predetermined delay energizes a solenoid after the primary switch contact transitions from a first stable position to a second stable position.

20 Claims, 6 Drawing Sheets

FIGURES 2(a–e)
PRIOR ART

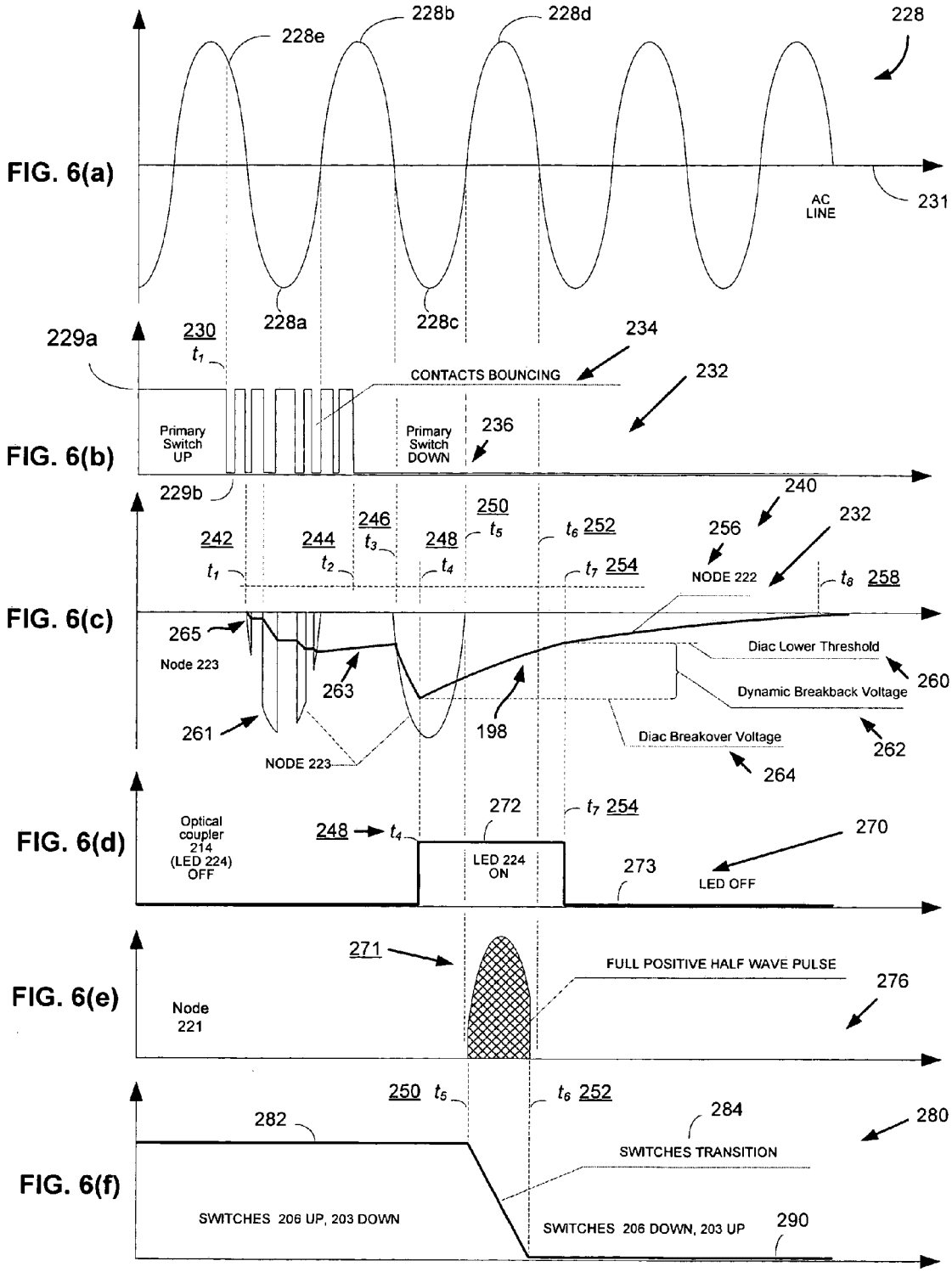
FIGURES 6(a-f)

CONTROLLED SOLENOID DRIVE CIRCUIT

BACKGROUND

1. Field of the Invention

The present invention is generally directed to remote control switches. More particularly, the present invention is directed to remote control switches, such as lighting contactors that are electromagnetically-operated, mechanically held switch. One such remote control switch is disclosed in U.S. Pat. No. 4,430,579 which is herein entirely incorporated by reference and to which the reader is directed for further information. Such switches may be utilized in a wide range of different applications and are typically used for controlling lighting, heating and other like or similar type loads. A conventional remote control switch comprises essentially a circuit disconnect device that may be operated from one and/or a plurality of separate or interrelated control stations. Such control stations may be spread out over an area such as locally dispersed within a room, across a building, or some other remotely located area. However, aspects of the invention may be equally applicable in other scenarios as well.

2. Description of Related Art

A general diagram of a conventional remote control electromechanical switch circuit 10 is illustrated in FIG. 1. As can be seen from FIG. 1, remote control electromechanical switch circuit 10 comprises a primary switch 12 coupled to a remote control switch 14. Primary switch 12 comprises mechanical contacts 40. Primary switch 12 is coupled to AC line 28 and to an input of remote control switch 14. Mechanical contacts 40 of primary switch 12 may be switched or positioned in either an up position 30 or a down position 32. FIG. 1 illustrates the mechanical contacts 40 of switch 12 in an up position 30. Primary switch 12 is utilized to provide AC power from AC line 28 to remote control switch 14. AC line 28 may comprise a conventional industrial AC line having 115/220 VAC, 50/60 Hz, however, the primary switch 12 may be utilized with other power grids as well.

Remote control switch 14 comprises a first set of contacts 16, a diode 20, a solenoid 24, and a second set of contacts 26. The first set of contacts 16 is coupled to an output of primary switch 12 whereas the second set of contacts 26 powers a load 27.

Both solenoid control switch 36 and power load switch 38 are physically linked to solenoid 24. Solenoid control switch 36 and a power load switch 38 have certain stable, mechanically locked positions and certain of these positions are illustrated in FIG. 1. For example, solenoid control switch 36 is illustrated in a down stable position 34 while power load switch 38 is illustrated in an up or open stable position 26*a*. In this up or open position 26*a*, load 27 remains unconnected AC line is continuously coupled to the primary switch 12. When primary switch contact 40 moves from the up position 30 to the down position 32, the solenoid 24 energizes and thereby moves both of the physically linked contacts 16 and contacts 26 until a closed solenoid position 26*b* is reached. In this closed solenoid position 26*b*, the solenoid 24 is disconnected from the line 28 via open contacts 16 in position 36. Operation and control of remote control switch 14 may be explained in detail with reference to the various timing diagrams illustrated in FIGS. 2(*a*-*e*).

For example, FIG. 2*a* illustrates an exemplary AC line voltage 28 that may be applied to primary switch 12 and that is eventually applied at node 18 of mechanical remote control circuit 10. Node 18 resides after contact 16 but before diode 20 in FIG. 1. Once AC line voltage 28 appears at diode 20 (such as at point 28*a* in FIG. 2*c* diode 20 conducts only a positive half wave of the applied AC power to solenoid 24. Consequently, this half wave voltage of AC voltage 28 will be applied to solenoid control switch 36 and is input to diode 20. In one arrangement of such a remote control switch 14, a one complete half wave of incoming AC voltage 28 (FIG. 2*a*) is sufficient to complete a switch transition. Such a switch transition may typically occur on the order of approximately from about 5-7 milliseconds to about 10 milliseconds. A customer load 27 will be connected via power load switch 38 once the second set of contacts 26 of remote control switch 14 are completed or made.

In a first stable position, the contacts 40 of primary switch 12 reside in the upper position 30 and the contacts 26 of the solenoid control switch 38 also resides in the upper position 26*a* as illustrated in FIG. 1. When primary switch 12 is first activated (i.e., when the contacts 40 of switch 12 are switched from the upper position 30 to lower position 32), a first positive half wave of AC input voltage 28 (such as at point 28*a* in FIG. 2*a*) passes diode 20 and energizes the solenoid 24. The energized solenoid 24 pulls in both sets of mechanical contacts 26 and 16, contacts 26 then move to a second stable position 26*b* and thereby provides power to the coupled load 27.

The first positive half wave at point 28*c* of AC power 28 (FIG. 2*a*) toggles both groups of contacts (i.e., solenoid control switch 16, optional auxiliary contacts (not shown) and power load switch 26). When solenoid control switch 16 is first toggled, solenoid 24 is mechanically disconnected from AC input voltage 28. Remote control switch 14 has now moved into its second stable position 26*b* and remains in this second stable position 26*b* until primary switch 12 is again actuated.

There are certain concerns that may arise with conventional mechanical switching circuits, such as the conventional circuit 10 illustrated in FIG. 1. For example, one concern relates to certain mechanical contact bounce, or contact "chattering" that may occur with the contacts 40 of primary switch 12. For example, because moving contacts 40 of primary switch 12 has a certain mass associated with its structure as well as a certain spring rate with low damping, contacts 40 tend to bounce as they make and break a completed circuit. That is, when these normally open pair of contacts 40 are closed, these contacts 40 often tend to initially come together ("make") and then tend to bounce/chatter off one another several times ("break") before the contacts finally come to rest or remain in a desired (i.e., closed) stable position. Such contact bounce may result in unwanted contact arcing and this may unduly limit the operational lifetime of the contacts of primary switch. For example, certain consequences of this making and breaking of the primary switch contacts 40 may be illustrated in the timing diagram in FIGS. 2*b*-2*e*, and importantly the timing diagram 50 illustrated in FIG. 2*b*.

As shown in timing diagram 50 illustrated in FIG. 2*b*, when the contacts 40 of the primary switch 12 are in the first up position 30 and then when the contacts 40 are switched to closed or down position 32, contacts 40 of primary switch 12 have a tendency to remain in an un-stable position, somewhere between the contact open position 30 and the contact closed position 32. The contacts will eventually, however, reside in the down position 32 but only after a certain period of time $t_1$ 44. Depending on certain aspects of switch construction, mechanics, and design, such mechanical contact bounce can last up to approximately 15 milliseconds to 20 milliseconds. That is, as illustrated in FIGS. 2*b* and 2*c*, contact bounce $T_{cb}$ 43 may last from $t_0$ 42 to $t_1$ 44. For further information on such mechanical bounce and its related issues, the reader is directed to http://www.elexp.com/t_bounc.htm which is herein entirely incorporated by reference and to which the reader is directed for further information.

Such contact bounce is normally undesired. For example, such contact bouncing often tends to interrupt current flow, as such current flow is eventually applied to energize a solenoid of a remote control switch, such as solenoid 24 illustrated in FIG. 1. For example, a timing diagram 56 of such a potentially problematic current flow is illustrated in FIG. 2*c*. FIG. 2*c* illustrates a timing diagram 56 that represents the current available at node 18 directly before diode 20 as contacts 40 go through a bouncing state, transitioning between the up position 30 and the closed positions 32 illustrated in FIG. 2*b*. As can be seen from timing diagram 56, contact bounce results in intermittent power or intermittent energy 52 during the one period from $t_0$ 42 to $t_1$ 44. The intermittent power or energy 52 is available at diode 20 and before solenoid 24. Contact bounce/chatter can adversely affect current flow and can also cause undesired contact arcing.

Consequently, as the timing diagram 58 of FIG. 2*d* illustrates, there is limited or insufficient energy 60 available at node 18 for solenoid 24 to make a complete mechanical transition from its initially open stable state 26*a* to a desired closed stable state 26*b*. Sufficient energy 62 to make such a transition will be available only once the electrical bounce or chatter of contacts 40 of switch 12 has subsided. FIG. 2*d* illustrates a timing diagram of the varying energy that will be present after the diode 20 at node 22 but before solenoid 24. Therefore, as illustrated in FIGS. 2*d-e*, prior to time $t_2$ 70, there is insufficient energy to complete a mechanical transition of second set of contacts 26. As illustrated in FIG. 2*e*, during contact bounce as illustrated in FIGS. 2*b* and 2*c*, there is incomplete mechanical transition 66 that occurs during switch bounce illustrated in FIG. 2*b*. It is only after a certain period of time that takes into account contact bounce that there is a sufficient amount of energy available so that a complete mechanical transition 68 can occur. Consequently, the control of remote control switch 14 illustrated in FIG. 1 tends to be inconsistent. This is true in part since the primary switch 12 may be switched at any time during the line voltage 28. For example, under certain ordinary operating conditions, the remote switch completes its transition within a half of period of the line voltage such as within about 8.33 ms for 60 Hz AC line voltage and about 10 ms for 50 Hz AC line voltage.

Therefore, when a duration of contact bounce or chatter is critical to a switch transition time, remote control switch 14 will not have enough stored energy to make a reliable transition between an initial open state and a desired closed state. Therefore, as contacts 40 are loaded, contacts 40 will have a tendency to experience electrical chatter. This chatter may occur because solenoid 24 is not able to solidly transition from its open state to a closed state during this switch transition time.

One technique that has been utilized in an attempt to reduce or eliminate such mechanical contract bounce is to provide a circuit that introduces a solid state switch between the primary switch 12 and the remote control switch 14. For example, FIG. 3 illustrates such a solid state based solenoid control circuit 13.

However, even such typical electronic solid state switch designs present certain operating and control limitations. For example, a solid state switch 48 coupled between a mechanical primary switch 12 and remote control switch 14 eliminates contact bouncing. However, one such concern with such an electronic solid state switch construction relates to what occurs if AC power is applied after solenoid 24. That is, if AC power is applied to solenoid 24 after the beginning of a positive half wave of input AC voltage. As with the use of an electromechanical primary switch 12, there may be insufficient energy to complete a switch transition. This concern regarding insufficient switch transition energy and the resulting synchronization issues with utilizing a solid state based switch raised by these concerns may be generally illustrated in the various timing diagrams presented as FIGS. 4(*a-e*).

Returning to FIG. 3, FIG. 3 illustrates a solid state switch 48 coupled to a primary switch 12 and remote control switch 14. Such a solid state switch 48 may comprise different solid state semiconductors such as triacs, MOSFETs, IGBTs, SCRs, as well as other like solid state components. In this exemplary arrangement, solid state switch 48 comprises a first triac 46 and a second triac 54 however other alternative arrangement may also be utilized. Also in this exemplary arrangement, a mechanical primary switch 12 (with potential contact bounce limitations) is utilized for solenoid control. In an up position 30 of a primary switch 12, the first triac 46 will be in an ON state while the second triac 54 will be in an OFF state. FIGS. 4(*a-e*) illustrate various timing diagrams for the solid state based switch circuit 13. For example, FIG. 4*a* illustrates a timing diagram of the AC line voltage 28 and FIG. 4*b* illustrates a timing diagram 80. FIG. 4*c* illustrates a timing diagram 88 that represents a voltage available at node 18 directly before diode 20 as solid state switch 48 transitions from an OFF state to an ON state. Transitioning between the OFF state and the ON state illustrated in FIG. 4*b*. As can be seen from the timing diagram 88 in FIG. 4*c*, even for the solenoid control circuit 13 utilizing a solid state switch 48, depending on where during the AC line cycle 28 that the solid state switch 48 transitions between its ON and OFF state (and where the primary switch 12 transitions between its up and down position (as shown in this example, transition occurs at point 28*d* in FIG. 4*a*), there may still be insufficient or intermittent power or energy 102 available at diode 20. Therefore, there will be insufficient energy to drive solenoid 24. Consequently, as the timing diagram 104 of FIG. 4*d* illustrates, even when utilizing a solid state switch 48, there will often be insufficient energy available at node 18 for solenoid 24 to make a complete mechanical transition 111 from its closed state to the desired open state. Sufficient energy to make such a complete mechanical transition will be available only once the electrical bounce or chatter of contacts 40 of switch 12 has subsided. FIG. 4*d* provides a timing diagram illustrating the varying amount of energy that will be present after the diode 20 at node 22 but before solenoid 24.

Therefore as can be illustrated in the various timing diagrams illustrated in FIGS. 4*d-e*, prior to time $t_1$ 71, there is insufficient energy 102 to complete a mechanical transition of second set of contacts 26. As can be seen from FIG. 4*e*, it is only after time $t_1$ 71 that a complete mechanical transition 111 can occur. Consequently, as with the mechanical control switch illustrated in FIG. 1, control of the remote control switch 14 illustrated in FIG. 3 even utilizing solid state switch 48 will tend to be inconsistent.

There is, therefore, a general need for a solenoid control circuit that provides for a controlled solenoid circuit that can consistently provide a sufficient amount of energy for contact closure. Also, there is a general need for a controlled solenoid circuit that reduces or even eliminates contact bounce or chatter. There is also, therefore, a general need for a control circuit that reduces certain undesired contact heating, contact arcing, and/or contact wear that can oftentimes occur during unwanted contact bounce.

SUMMARY

According to an exemplary embodiment, a solenoid drive circuit is provided. The circuit comprises a solenoid drive circuit input coupled to a primary switch. The primary switch comprises a first set of contacts residing in a first stable position. A remote control switch is coupled to an output of the primary switch and the remote control switch comprises a solenoid drive circuit having a predetermined delay. The predetermined delay energizes a solenoid after the primary switch contact transitions from a first stable position to a second stable position.

In an alternative arrangement, a controlled solenoid drive circuit comprises a primary switch, the primary switch is coupled to a line voltage and comprises a first set of contacts. A solenoid control switch is coupled to the first set of contacts, the solenoid control switch comprising a second set of contacts. A solenoid drive circuit has a time delay. The solenoid drive circuit is coupled between an output of the second set of contacts and a solenoid. After activating the primary switch, the solenoid drive circuit activates the solenoid after an expiration of the time delay.

In yet another alternative arrangement, a method of providing a controlled amount of power to a solenoid is provided. The method comprises the step of providing a primary switch, the primary switch comprises a set of mechanical contacts that transition between a first position and a second position and the step of receiving an input voltage at an input of the primary switch. A secondary switch is provided to an output of the primary switch, the secondary switch comprising a solenoid drive circuit. A switch transition is achieved from a first position to the second position during a single positive half wave of the input voltage.

These as well as other advantages of various aspects of the present invention will become apparent to those of ordinary skill in the art by reading the following detailed description, with appropriate reference to the accompanying drawings.

BRIEF DESCRIPTION OF THE DRAWINGS

Exemplary embodiments are described herein with reference to the drawings, in which:

FIG. 6*a* is a line voltage of the AC line for the schematic illustrated in FIG. 5;

FIG. 6*b* illustrates a timing diagram of the controlled solenoid drive circuit of FIG. 5;

FIG. 6*c* illustrates a timing diagram of the diode illustrated in the controlled solenoid drive circuit of FIG. 5;

FIG. 6*d* illustrates a timing diagram of the LED 224 in the optical coupler 214.

FIG. 6*e* illustrates a timing diagram of voltage across the solenoid illustrated in the controlled solenoid drive circuit of FIG. 5;

FIG. 6*f* illustrates a timing diagram of the mechanical transition of switches 203 and 206 illustrated in the controlled solenoid drive circuit of FIG. 5;

DETAILED DESCRIPTION

Figure 5:
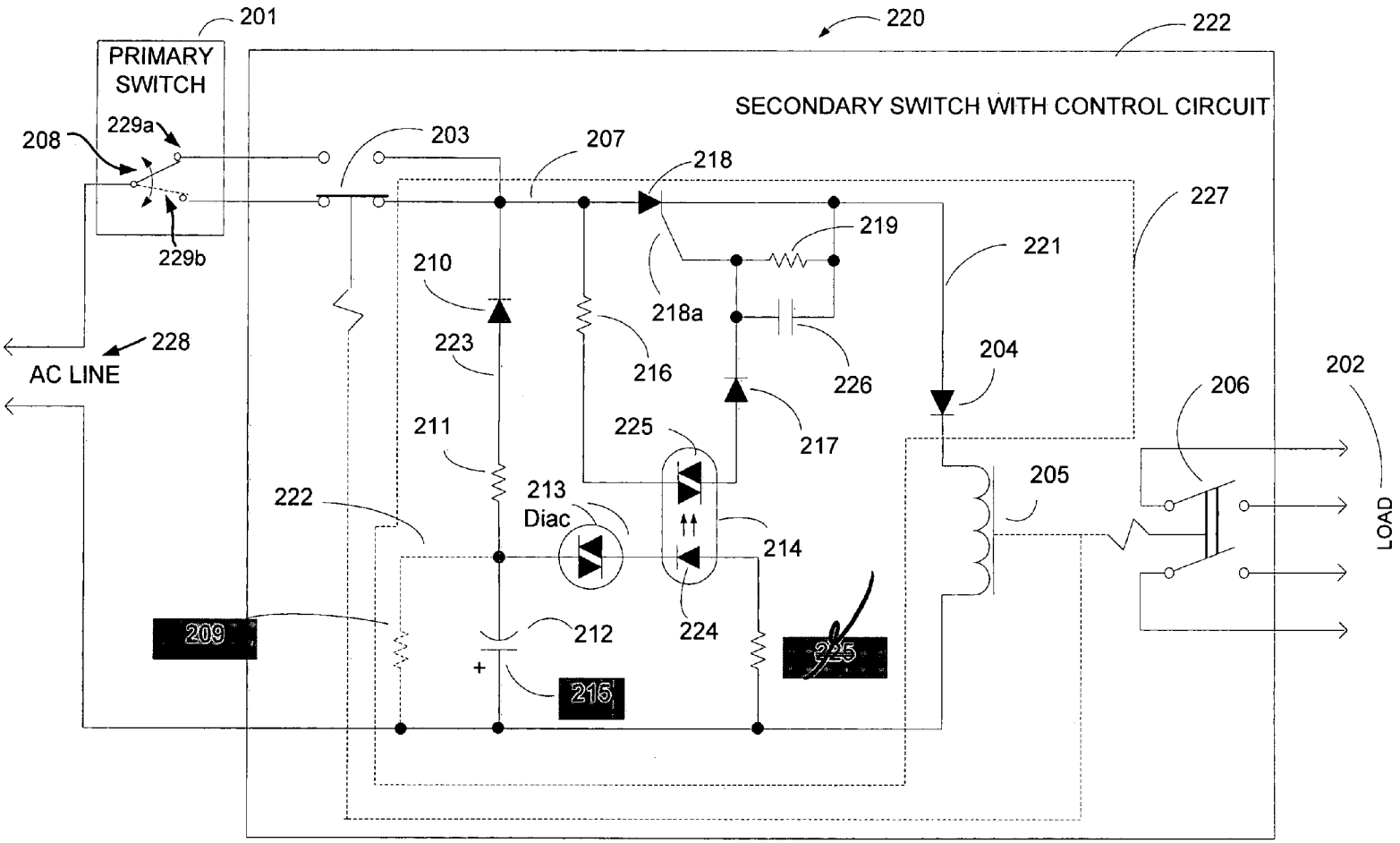
FIG. 5 illustrates an electrical schematic of a switching circuit incorporating certain aspects of a preferred controlled solenoid drive circuit.

A schematic diagram of one remote control switch arrangement 220 incorporating aspects of the present invention is illustrated in FIG. 5. In one arrangement, remote control switch 220 comprises primary switch 201 and secondary switch with control circuit 222. Various timing diagrams resulting from the remote control switch arrangement 220 illustrated in FIG. 5 are illustrated in FIGS. 6(*a-f*).

FIG. 5 illustrates a remote control switch 220 comprising a primary switch 201 and a secondary switch 220 with a solenoid control drive circuit 227. In one arrangement, the primary switch 201 comprises mechanical switch and in an alternative arrangement, the primary switch 201 comprises a solid-state switch. In an alternative arrangement, where the primary switch 201 comprises a mechanical switch, the primary switch 201 comprises contacts 208 and is coupled to AC line 228 and an input to the secondary switch with control circuit 222.

In one arrangement, secondary switch 222 comprises a first set of contacts 203, a solenoid 205, a second set of contacts 206, and a solenoid control drive circuit 227. As will be described in detail below, the various electrical components making up the solenoid control drive circuit 227 are selected so as to define a controlled or predetermined transition period after the primary switch 201 is transitions from a first to a second stable state. In other words, the various electrical components making up the solenoid control drive circuit 227 are pre-selected so as to achieve a controlled or predetermined contact closure delay after the primary switch 201 transitions contacts 208 from 229*a* to 229*b* and before the solenoid 205 is energized so they close solenoid contacts 206.

For example and as illustrated in FIG. 6*b*, primary switch 201 of FIG. 5 comprises contacts 208 that may reside in either an up position 229*a* or in a down position 229*b*. According to one arrangement, the drive circuit 227 is coupled between the first set of contacts 203 and the solenoid 205 and preferably comprises the following components:

diodes 210, 217 and diode 204 coupled to solenoid 205;

power SCR 218;

resistors 211, 216, 219, and bleed resistor 220;

capacitors 212, 226;

optical coupler 214 comprising led 224 and optical triac 225 and threshold device 213 having a predetermined threshold or breakover level.

Preferably, the threshold device 213 may utilize different types of technologies including but not limited to such as: technologies as diacs, comparators, Zener diodes or other like solid-state components. Those of ordinary skill in the art will recognize that other electrical component configurations and/or selections may also be utilized.

Referring now to FIG. 5 and FIG. 6*a*, the contacts 208 for primary switch 201 begin in an up position 229*a* and travels to a down position 229*b*. This contact travel begins traveling down at a time $t_1$ 230. As can be seen from FIG. 6*a*, contact travel commences at time $t_1$ 230 and notably, this initial contact travel commences during a first portion 228*e* of a positive cycle of line voltage 228. That is, contact travel does not commence when the AC line voltage 228 traverses the x-axis 231.

Figure 1:
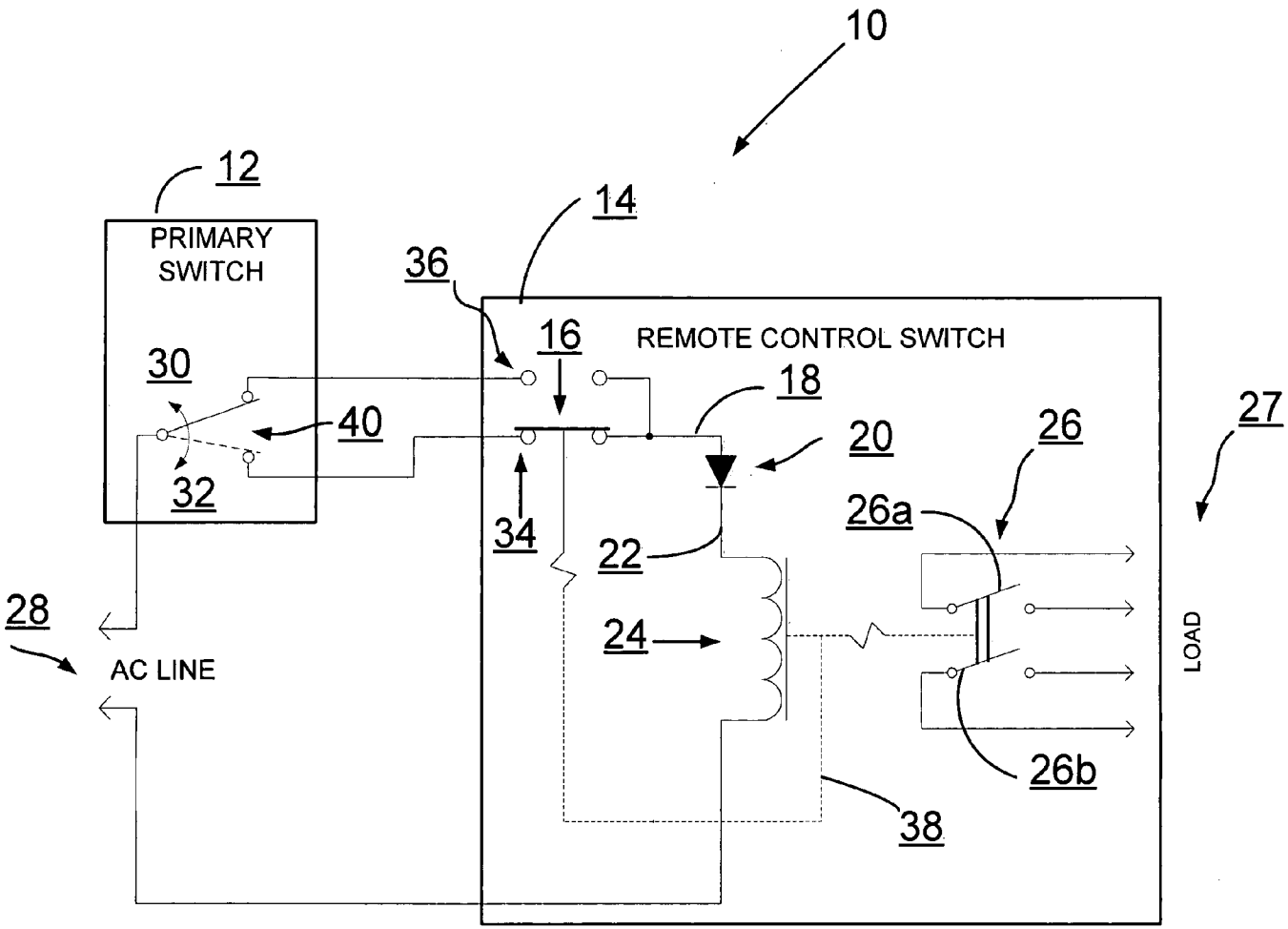
FIGURE 1 Prior Art
FIG. 1 illustrates a typical schematic for a primary switch and a remote control electromechanical switch.

When moveable contact 208 of primary switch 201 touches a lower ("normally open") contact, contact 203 of secondary switch 222 passes a certain amount of current. For example, referring to FIGS. 6*b* and 6*c*, at time $t_1$ 242, while contact 208 first bounces 234 between a down position 229*b* and an up position 229*a*, an initial small, amount of current proportional to staggered voltage 265 temporarily flows through node 223 and capacitor 212. At the same time, an AC voltage appears at node 207. As previously discussed with respect to the prior art control circuit schematic 10 illustrated in FIG. 1, the contact bounce of contacts of primary switch 201 creates an intermittent or temporary voltage spike at control circuit node 207. As such, because of the biased nature of diode 210 illustrated in FIG. 5, first diode 210 will only pass various portions of negative half wave 261 of an input voltage 228 (a portion of voltage 228 in FIG. 6*a*) to node 223. Therefore, a signal at control circuit node 223 will represent a chopped negative half wave 261 of input voltage 228.

Returning now to FIG. 5, as this chopped negative voltage 261 is being applied at node 223, capacitor 212 will begin charging but will only charge during the negative period 228*a* of AC input voltage 228 and will be charged through resistor 211. During a subsequent positive period 228*b* of an input AC voltage 228, because of the capacitor's polarity, capacitor 212 will discharge. Preferably, capacitor 212 will discharge by way of a bleed resistor, such as bleed resistor 220. In one preferred arrangement, bleed resistor 220 will have a resistance valued that is greater than the resistance values of resistor 211. For example, in one preferred arrangement, resistor 220 may have a value of approximately 50 kiloOhms while resistor 211 may have a value of approximately 3 kiloOhms, however, other arrangements may also be used. Therefore, during a positive period of AC input voltage 228, such as during positive period 228*b* of AC input voltage 228 of FIG. 6, capacitor 212 will maintain its stored charge.

FIG. 6*c* illustrates the voltage available at nodes 207 and 223 of FIG. 5. As illustrated in FIG. 6*c*, at time $t_4$ 248, a voltage across capacitor 212 will generally exceed a breakover voltage 264 of diac 213. Such diac 213 is generally a bidirectional trigger diode that is designed specifically to trigger a triac or an SCR. Generally, such a diac will not conduct until a breakover voltage (such as diac breakover voltage 264) is reached. At such a breakover voltage point, the diac goes into avalanche conduction. At such a point, the diac 213 also exhibits a negative resistance characteristic, and the voltage drop across the diac snaps back, typically about 5 volts, creating a breakover current sufficient to trigger the triac or SCR. In one preferred arrangement, such a breakover voltage may comprise from generally about 5 to about 40 volts. As those of ordinary skill will recognize, other threshold device configurations with predetermined breakover voltages may also be utilized. For example, a threshold device may include some advanced features such as a feature that does not allow a threshold device turning into a conducting state if the line voltage is lower or greater than a particular voltage range specified for a particular solenoid. It provides a failure-free operation at low line condition and may prevent solenoid damage at a high line condition.

Therefore and as illustrated at time $t_4$ 248 in the timing diagram 270 of FIG. 6*d*, once the breakover voltage 264 of diac 213 has been exceeded, diac 213 will turn into a conducting state and, in the arrangement illustrated in FIG. 5, this occurs at time $t_4$ 248. Preferably, breakover voltage 264 of diac 213 is chosen so as to provide a controlled or sufficient amount of time for primary switch 201 to complete or ride through any potential contact bounce or chatter that occurs when the contacts are moved from the first position 229*a* to the second position 229*b*. For example, in one preferred arrangement, the diac breakover voltage 264 is predetermined and may be user defined so as to generally provide about 10 to generally about 50 milliseconds of time. In certain typical applications, such a predetermined timing delay will avoid potential contact bounce. In one preferred arrangement, diac breakover voltage 264 will occur during a negative half wave 228*c* of input voltage 228 (see FIG. 6*a*), since capacitor 212 will have been charging during this period.

Once the diac 213 transitions from a non-conducting state to a conducting state, this diac's conductive state causes a discharge of current from a positive pole 215 of capacitor 212 via resistor 225 and LED 224 (preferably an optical coupler 214) to a negative pole 222 of capacitor 212. Therefore LED 224 (of optical coupler 214) turns ON at time $t_4$ 248. This is illustrated in the timing diagram 270 of FIG. 6*d*. As shown in timing diagram 270 of FIG. 6*d*, LED 224 remains in an ON state 272 beginning at time $t_4$ 248 until an LED current drops and diac 213 turns to an OFF state 273. Diac 213 turns to an OFF state at time $t_7$ 254 and is generally illustrated in FIG. 6*e*.

Optical triac 225 turns to its ON state at the same time $t_4$ 248 and remains in this ON state at least until time $t_5$ 250 where the positive half cycle 228*d* of line voltages 228 begins. Where this occurs along the line voltage 228 is important since the switch 201 will begin its transition at the start of a positive cycle 228*d* of line voltage 228 rather than in the middle of a positive cycle such as at 228*e* illustrated in FIG. 6*a*.

During a subsequent positive half wave of input voltage 228 comes at time $t_5$ 250, when optical triac 225 remains in a conducting state. Therefore, a positive potential from node 207 is present on resistor 216 and on optical triac 225. Diode 217 thereby powers a gate 218*a* of a power SCR 218. SCR 218 turns ON and conducts current via diode 204 to thereby energize solenoid 205. Energizing solenoid 205 pulls in contact 206 to thereby energize the load 202. Therefore, the solenoid drive circuit 227 illustrated in FIG. 5 enables solenoid 205 to receive a complete positive pulse 228*d* (FIG. 6*e*) of input voltage 228 rather than receive only some component thereof (such as occurs in circuit 10 of FIG. 1).

Figure 2:
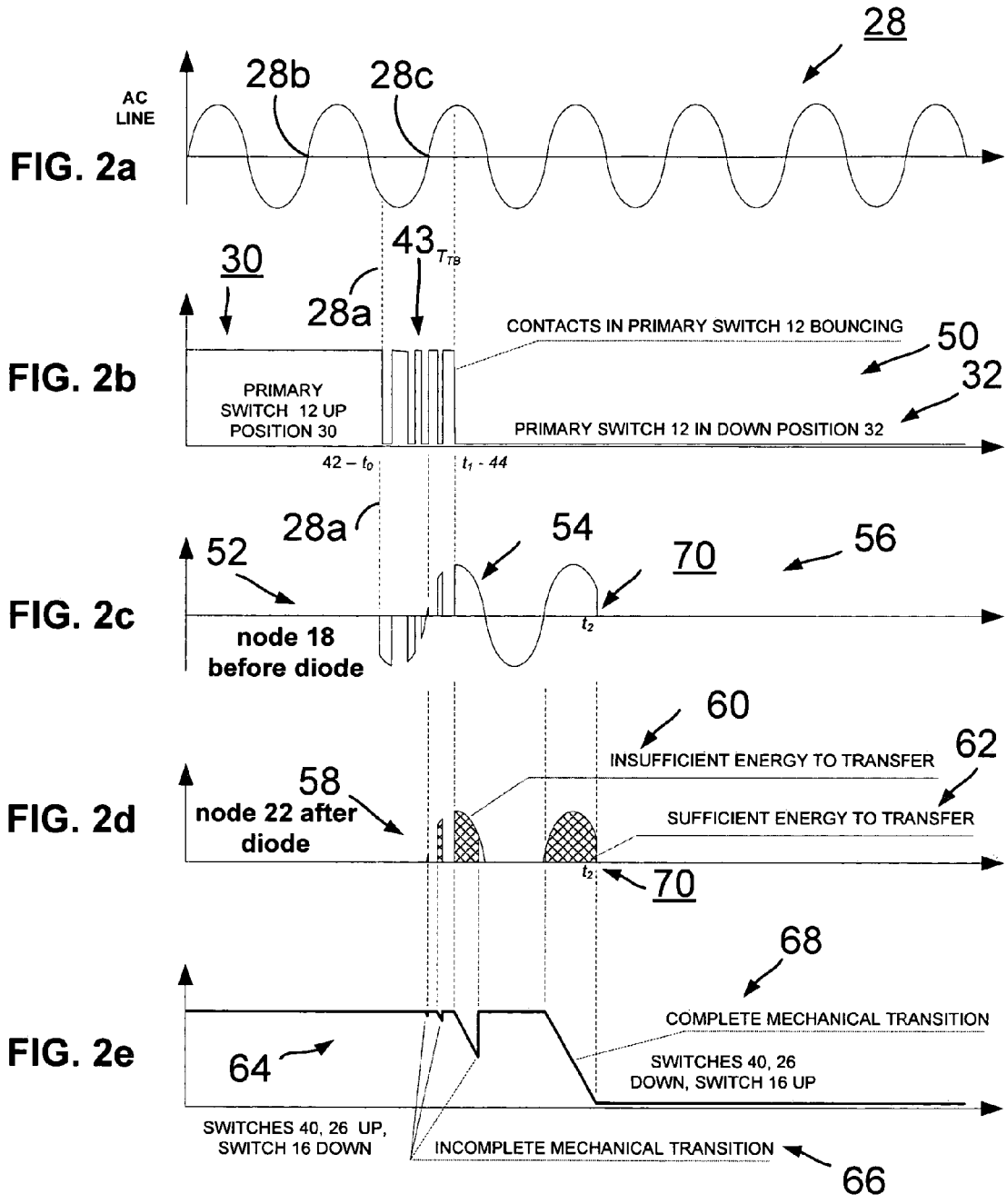
FIG. 2*a* is a line voltage of the AC line for the schematic illustrated in FIG. 1.
FIG. 2*b* illustrates a timing diagram of the primary switch illustrated in FIG. 1.
FIG. 2*c* illustrates a timing diagram of the diode illustrated in the remote control switch of FIG. 1.
FIG. 2*d* illustrates a timing diagram of voltage before the solenoid illustrated in the remote control switch FIG. 1.
FIG. 2*e* illustrates a timing diagram of the mechanical transition of switches 16, 26, and 40 illustrated in the remote control switch of FIG. 1.
Figure 3:
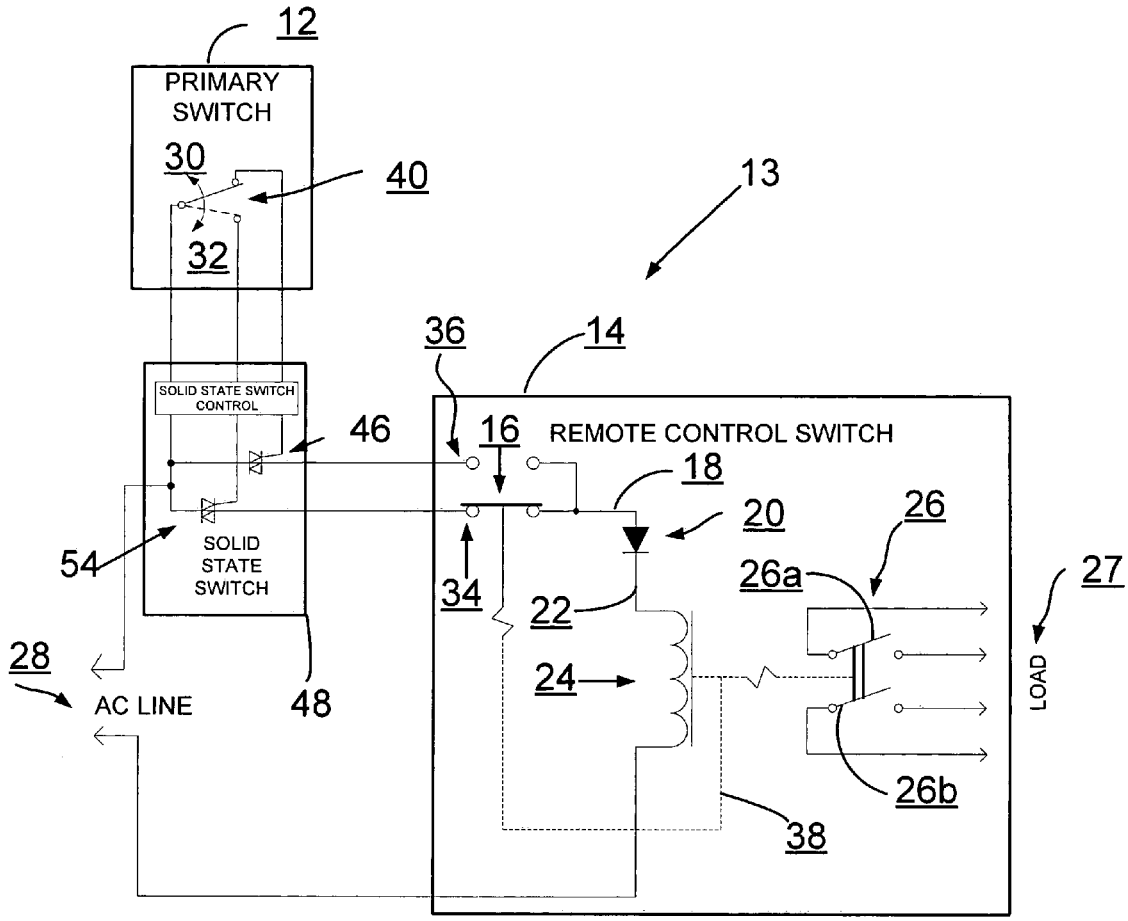
FIGURE 3 PRIOR ART
FIG. 3 illustrates a typical schematic for a primary switch and a remote control electromechanical switch utilizing a solid state switch.
Figure 4:
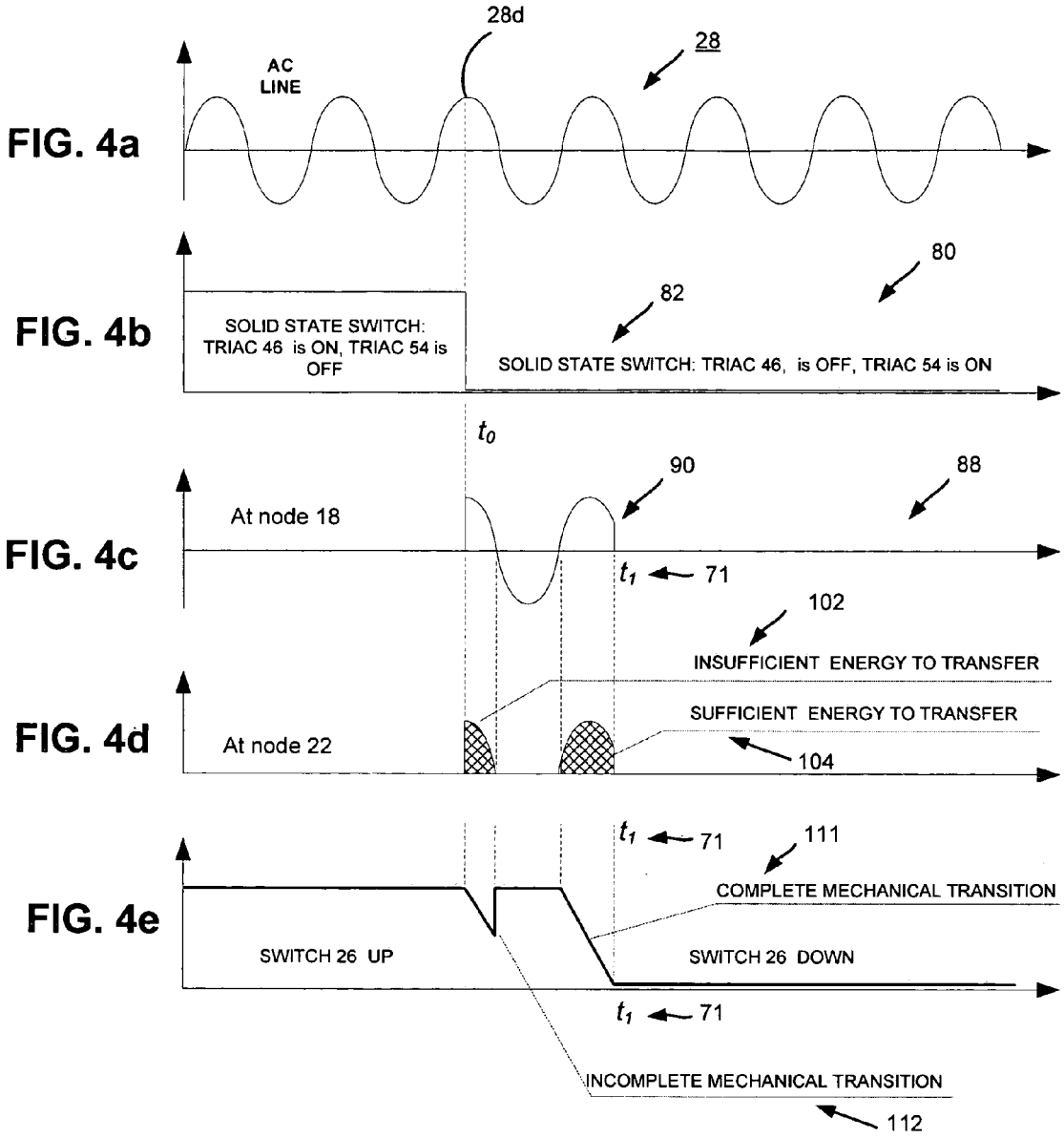
FIG. 4*a* is a line voltage of the AC line for the schematic illustrated in FIG. 3.
FIG. 4*b* illustrates a timing diagram of the primary switch that may be utilized with a solid state remote control switch illustrated in FIG. 3.
FIG. 4*c* illustrates a timing diagram of the diode illustrated in the solid state remote control switch illustrated FIG. 3.
FIG. 4*d* illustrates a timing diagram of voltage before the solenoid illustrated in the solid state remote control switch illustrated in FIG. 3.
FIG. 4*e* illustrates a timing diagram of the mechanical transition of switches 16, 26, and 40 illustrated in the solid state remote control switch illustrated in FIG. 3.

Therefore, since solenoid 205 receives a complete positive pulse 228*d* of input voltage 228, this allows for completing a mechanical transition of both switches 203 and 206 and this occurs at time $t_6$ 252. Mechanical transition of contacts 206 in FIG. 5 is therefore achieved without the incomplete mechanical interruptions that can typically can occur when utilizing the remote control circuit 10 illustrated in FIG. 1 and is generally explained by way of the timing diagrams illustrated in FIGS. 2(*a-e*) and the solid state remote control circuit illustrated in FIG. 3 and consequently explained by way of the timing diagrams illustrated in FIGS. 4(*a-e*). Reducing such mechanical interruptions also reduces certain concerns that may also arise due to contact arcing and the consecutive overheating of such contacts that this contact may cause.

Preferably, a value of first capacitor 212 that is coupled to the threshold device 213 is selected to allow a sufficient enough charging time so as to complete any possible bounce of primary switch 201. Therefore, any potential contact bounce will not affect switch transition. In one preferred arrangement, LED 224 (optical coupler 214) remains in an ON state or in a conducting state even after primary switch transition. That is, LED 224 (optical coupler 214) remains in an ON state or a conducting state until first capacitor 212 discharges via bleed resistor 209 to a lower threshold voltage of diac 213, such as the diac lower threshold 260 illustrated in FIG. 6*c*.

In one preferred arrangement, respective values of first capacitor 212, resistor 211 and resistor 209 are pre-selected so as to provide a controlled and predetermined charging and/or discharging time. Preferably, a charging time 292 (from $t_2$ 244 to $t_4$ 248) exceeds a maximum contact bounce time of the contacts 208 of primary switch 201.

Discharging time 198 of first capacitor 212 contains essentially two time different periods: a first time period from $t_4$ 248 to $t_7$ 254. Discharging time 198 also comprises a second time period defined as a timer period 232 extending from $t_7$ 254 to about $t_8$ 258. In one preferred arrangement, the first period of time is greater than half a period or half-cycle of an AC line voltage 228. In one preferred arrangement, first discharge period of time 294 should be approximately around 10- to about 50 milliseconds. Such a predetermined discharge period of time would be particularly advantageous where the primary switch 201 is utilized for a line voltage 228 comprising 50/60 Hz. Second period of time 296 shall also preferably exceed the electrical and mechanical transitions related to solenoid 205. Preferably, this period should not exceed the minimal specified time between two consecutive switching operations.

Exemplary embodiments of the present invention have been described. Those skilled in the art will understand, however, that changes and modifications may be made to these embodiments without departing from the true scope and spirit of the present invention, which is defined by the claims.

We claim:

1. A solenoid drive circuit, said circuit comprising:

a solenoid drive circuit input coupled to a primary switch, said primary switch comprising a first set of contacts residing in a first stable position; and a remote control switch coupled to an output of said primary switch, said remote control switch comprising a solenoid drive circuit having a predetermined delay, wherein said predetermined delay begins to energize a solenoid only after said primary switch contact transitions from said first stable position to a second stable position and only at a beginning of a subsequent positive cycle of a line voltage.

2. The invention of claim 1 wherein said primary switch comprises a mechanical primary switch.

3. The invention of claim 1 wherein said primary switch comprises a solid state primary switch.

4. The invention of claim 1 wherein said solenoid device circuit comprises a capacitor, said capacitor having a capacitance value that is selected to define a charging time.

5. The invention of claim 4 wherein said charging time is approximately on the order of 10 milliseconds.

6. The invention of claim 4 wherein said charging time is greater than at least one-half of a line voltage cycle.

7. The invention of claim 4 wherein said certain charging time is greater than an amount of time that said first set of contacts of said primary switch bounce after said primary switch is activated from a first contact position to a second contact position.

8. The invention of claim 4 wherein said certain charging time is approximately 10 milliseconds.

9. The invention of claim 1 wherein said predetermined delay comprises a first delay and second delay.

10. The invention of claim 9 wherein said first delay is greater than at least half period of said line voltage.

11. The invention of claim 1 wherein said predetermined delay energizes said solenoid after said primary switch contact transitions from said first stable position to said second stable position after a certain predefined period of time.

12. A controlled solenoid drive circuit, said circuit comprising:

a primary switch, said primary switch coupled to a line voltage and comprising a first set of contacts;

a solenoid control switch coupled to said first set of contacts, said solenoid control switch comprising a second set of contacts;

a solenoid drive circuit having a time delay; said solenoid drive circuit coupled between an output of said second set of contacts and a solenoid;

wherein after activating said primary switch to thereby energize said first set of contacts, said time delay of said solenoid drive circuit begins to activates said solenoid only after an expiration of said time delay, said time delay being at least a positive half period of said line voltage.

13. The invention of claim 12 wherein said solenoid is coupled to a third set of contacts.

14. The invention of claim 13 wherein said third set of contacts is coupled to a load.

15. The invention of claim 12 wherein said lighting load.

16. A method of providing a controlled amount of power to a solenoid, said method comprising the steps of:

providing a primary switch, said primary switch having a set of mechanical contacts that transition between a stable first position and a stable second position;

receiving an input voltage at an input of said primary switch;

coupling a secondary switch to an output of said primary switch, said secondary switch comprising a solenoid drive circuit; and achieving a switch transition from said first stable position to said second stable position after a subsequent single positive half wave of said input voltage.

17. The invention of claim 16 wherein said set of mechanical contacts of said mechanical switch transition between a first stable position and a second stable position.

18. The invention of claim 16 wherein said solenoid drive circuit defines a certain predetermined delay period for when the mechanical switch transitions between said first and said second position.

19. The invention of claim 16 wherein, during switch transition, said switch becomes decoupled from said AC input source.

20. The invention of claim 16 further comprising the step of waiting a certain period of time before said mechanical switch transitions from said first to said second position.

* * * * *

UNITED STATES PATENT AND TRADEMARK OFFICE

CERTIFICATE OF CORRECTION

PATENT NO. : 7,715,168 B2
APPLICATION NO. : 11/429777
DATED : May 11, 2010
INVENTOR(S) : Gofman et al.

It is certified that error appears in the above-identified patent and that said Letters Patent is hereby corrected as shown below:

At item (75) of the Title Page

Please delete "Joseph T Webber, Jr." and replace with "Joseph T. Weber, Jr."

Signed and Sealed this

Twelfth Day of October, 2010

David J. Kappos

David J. Kappos
*Director of the United States Patent and Trademark Office*